US006189553B1

(12) United States Patent
Barker et al.

(10) Patent No.: US 6,189,553 B1
(45) Date of Patent: Feb. 20, 2001

(54) SUNROOM FOR POP-UP TYPE CAMP TRAILER

(76) Inventors: Wayne L. Barker; Carolann Barker, both of 1715 12th Ave. SE., Puyallup, WA (US) 98372

( * ) Notice: Under 35 U.S.C. 154(b), the term of this patent shall be extended for 0 days.

(21) Appl. No.: 09/408,501

(22) Filed: Sep. 30, 1999

(51) Int. Cl.[7] ..... E04H 15/08
(52) U.S. Cl. ..... 135/88.1
(58) Field of Search ..... 135/88.1, 88.13, 135/88.15, 87, 117, 121

(56) References Cited

U.S. PATENT DOCUMENTS 1,560,110 * 11/1925 Skog ..... 135/117
3,084,703 * 4/1963 Lefebvre et al. ..... 135/88.1
4,066,089 * 1/1978 Rainwater ..... 135/117
5,439,018 * 8/1995 Tsai ..... 135/121
5,671,766 * 9/1997 Williams ..... 135/87
5,718,253 * 2/1998 McNamee ..... 135/88.1
6,053,792 * 4/2000 Sallee et al. ..... 135/87

* cited by examiner

*Primary Examiner*—Alvin Chin-Shue
*Assistant Examiner*—Sarah Purol

(57) ABSTRACT

A tent-like structure for a pop-up type camp trailer is disclosed. The tent-like structure includes an A-type frame which is attached to the top surface of the trailer and a cover which is received thereon. The side panels and the adjacent top panels of the cover are provided with a plastic window arrangement permitting light to enter the tent-like structure. The front panel of the tent-like structure is provided with flaps formed from screening material and joined together by a zipper permitting individuals to enter and leave the tent-like structure and also permitting air to circulate within same while preventing insects from entering same.

5 Claims, 3 Drawing Sheets

SUNROOM FOR POP-UP TYPE CAMP TRAILER

TECHNICAL FIELD

The present invention relates, in general, to an attachment for a pop-up type camp trailer and, more particularly, to a sunroom attachment for such a trailer.

BACKGROUND ART

Camp trailers, such as of the pop-up type, have been extensively produced and used by many camping enthusiasts. Such pop-up type camp trailers typically provide sleeping quarters for the occupants thereof and, in some instances, permit the cooking of food therein. However, in most instances, such trailers are very small and confining. Because of this, the use of such camp trailers is limited to typically providing sleeping quarters and/or cooking facilities.

In view of the fact that pop-up camp trailers are very confining, it has become desirable to develop attachments thereto to increase the size thereof so that they can be used for other purposes.

SUMMARY OF THE INVENTION

The present invention solves the problems associated with the confining nature of presently available pop-up camp type trailers and other problems by providing an A-type frame which is attached to the top surface of the trailer and a cover which is received over the A-type frame forming a tent-like structure, i.e., a sunroom, to be formed on the trailer. The side panels and the adjacent top panels of the cover are provided with a plastic window arrangement permitting light to enter the tent-like structure. The front panel of the tent-like structure is provided with flaps formed from screening material joined together by a zipper permitting individuals to enter and leave the tent-like structure and also permitting air to circulate within same while preventing insects from entering same. The tent-like structure substantially increases the living space provided by a pop-up camp trailer.

DESCRIPTION OF THE PREFERRED EMBODIMENT

Figure 1:
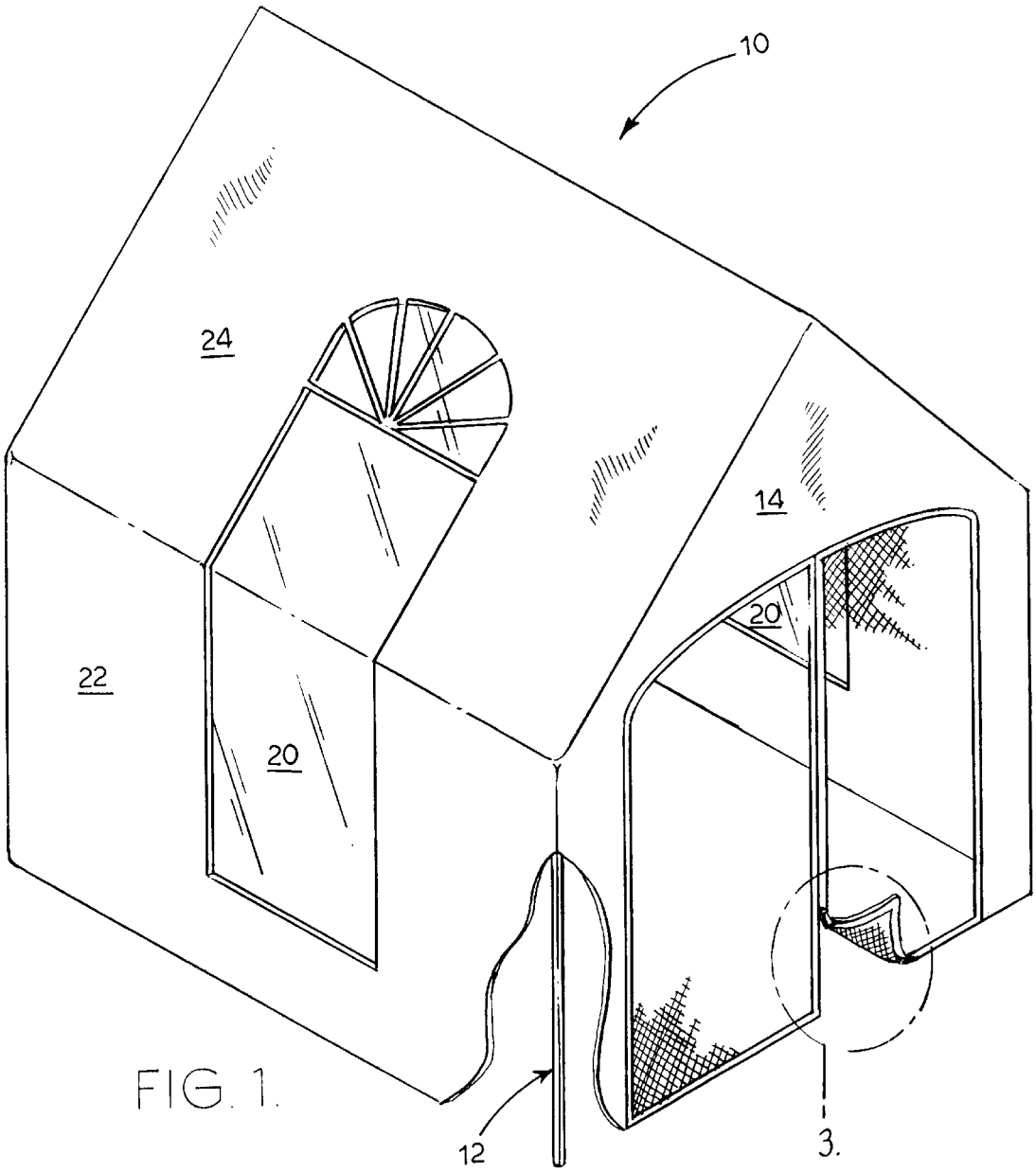
FIG. 1 is perspective view, partially broken away in cross-section, of the sunroom attachment of the present invention for use on a pop-up type camp trailer.

Referring now to the drawings where the illustrations are for the purpose of describing the preferred embodiment of the present invention and are not intended to limit the invention described herein, FIG. 1 is a perspective view, partially broken away in cross-section, of a sunroom 10 for a pop-up type camp trailer. The sunroom 10 includes an A-type metal frame 12 having four (4) upright corner posts, the bottoms of each of which is received within the top surface of a camp trailer (not shown). The tops of adjacent corner posts are connected by a substantially horizontal metallic post (not shown). The top of each corner post is also connected to the end of a gable post (not shown) positioned at an angle with respect to the horizontal. The opposite ends of adjacent gable posts are connected to a ridge post (not shown) which runs the length of the sunroom 10 and interconnects the top of the gable of the front surface 14 of the sunroom 10 with the top of the gable of the rear surface (not shown) of the sunroom 10.

Tent-like material (such as canvas) having a configuration complementary to that of the frame 12 is received over the frame 12 and is attached thereto by fastening means (not shown). A Plexiglas window 20 is positioned within opposite side surfaces 22 of the canvas material and extends into the adjacent top gable surface 24 of the canvas material.

Figure 2:
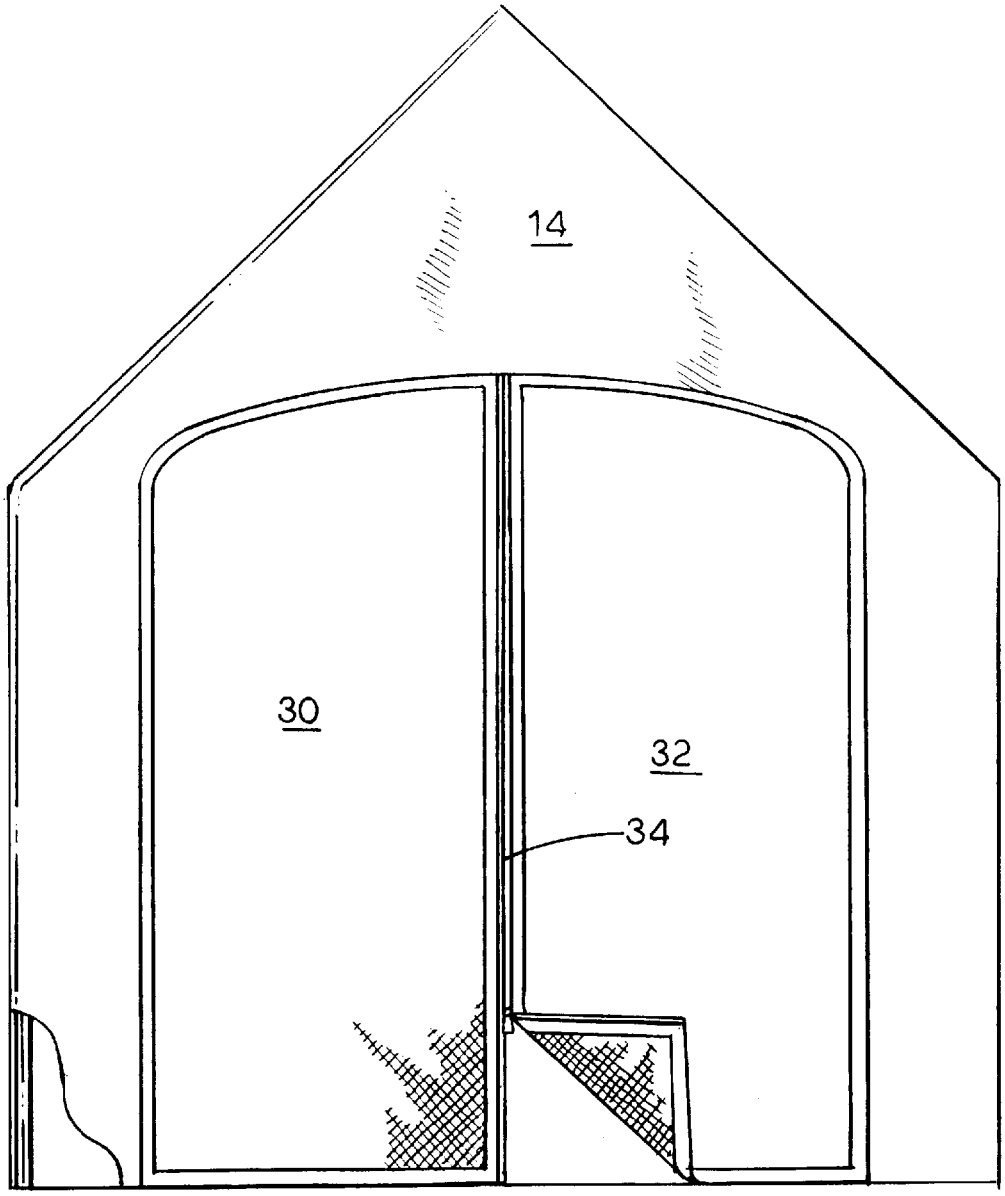
FIG. 2 is a front elevational view of the front panel of the sunroom attachment of the present invention shown in FIG. 1.
Figure 3:
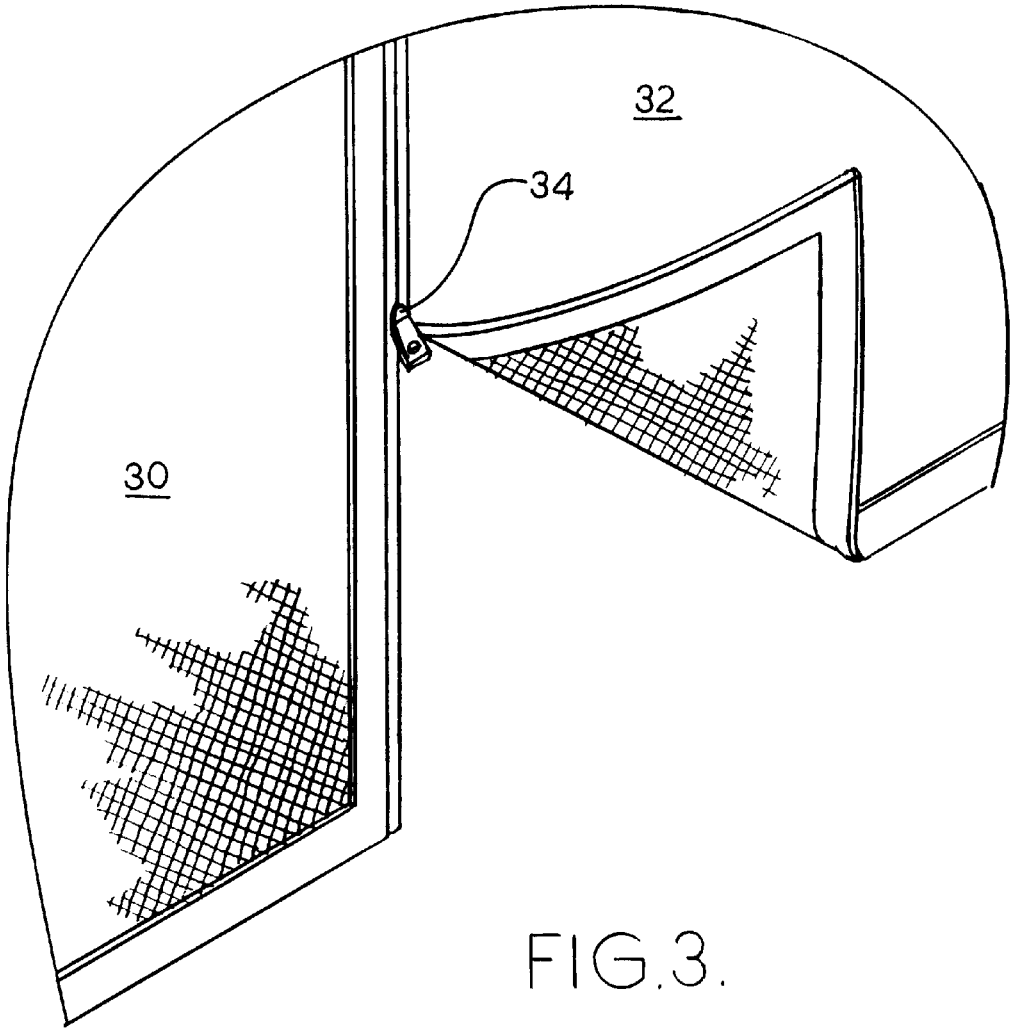
FIG. 3 is an exploded perspective view of the zipper arrangement which joins the screen-like flaps provided in the front panel of the sunroom attachment of the present invention.

Referring now to FIGS. 2 and 3, the front surface 14 of the sunroom 10 is shown and illustrates that two complementary flaps 30, 32 are provided within same and are interconnected by a zipper 34 arrangement. The flaps 30, 32 are formed from a screen-like material permitting air to enter the sunroom 10. In addition, the flaps 30, 32 can be opened by means of zipper 34 permitting entry into and exit from the sunroom 10 and can be closed to prevent insects from entering same.

The sunroom 10 of the present invention provides a number of advantages over presently available pop-up type camp trailers. In particular, the sunroom 10 enlarges the living or functional space of such a trailer and enables the occupants to enjoy being outdoors while providing some protection from wind, rain, dust and insects. Since the sunroom 10 extends for the length of the trailer and can also extend outwardly from the trailer, and utilizes a gable-type construction, it provides substantially more room than that presently available in camp trailers. Because of the increase in size, the sunroom 10 can also provide additional sleeping space for the occupants or guests thereof. The sunroom 10 can also be easily dismantled and rolled-up for storage in the trailer or within a tube mounted beneath the trailer. Thus, the sunroom 10 of the present invention substantially increases the usability of presently available pop-up type camper trailers, extends the living area of same, and provides protection from the elements.

Certain modifications and improvements will occur to those skilled in the art upon reading the foregoing. It is understood that all such modifications and improvements have been deleted herein for the sake of conciseness and readability, but are properly within the scope of the following claims.

We claim:

1. An attachment for a camp trailer comprising a frame and a cover received over said frame, said frame comprising a plurality of upright corner posts, substantially horizontal frame members interconnecting the tops of said corner posts, a plurality of gable posts interconnecting adjacent said corner posts, said gable posts being positioned at an angle with respect to the horizontal and having a first end and a second end, said first end of one of said gable posts being attached to said top of one of said corner posts, and a ridge post attached to said second end of one of said gable posts to interconnect oppositely disposed said gable posts.

2. The attachment as defined in claim 1 wherein said cover includes plurality of window members positioned within the surface of said cover so as to be in the substantial upright position when said cover is received on said frame member.

3. The attachment as defined in claim 1 wherein said cover includes oppositely disposed flaps which are interconnected by means of a zipper arrangement.

4. The attachment as defined in claim 3 wherein said oppositely disposed flaps are formed from a screen-like material.

5. The attachment as defined in claim 3 wherein said oppositely disposed flaps are positioned within the front surface of said cover.

* * * * *